US010711419B2

(12) United States Patent
Farhadzadeh et al.

(10) Patent No.: US 10,711,419 B2
(45) Date of Patent: Jul. 14, 2020

(54) BOARDWALK AND SIDEWALK SYSTEM WITH DUAL USE AS FLOOD CONTROL BARRIER

(71) Applicants: Ali Farhadzadeh, Ronkonkoma, NY (US); Jahangir S Rastegar, Stony Brook, NY (US)

(72) Inventors: Ali Farhadzadeh, Ronkonkoma, NY (US); Jahangir S Rastegar, Stony Brook, NY (US)

( * ) Notice: Subject to any disclaimer, the term of this patent is extended or adjusted under 35 U.S.C. 154(b) by 0 days.

(21) Appl. No.: 15/382,332

(22) Filed: Dec. 16, 2016

(65) Prior Publication Data

US 2017/0175352 A1 Jun. 22, 2017

Related U.S. Application Data

(60) Provisional application No. 62/268,469, filed on Dec. 16, 2015.

(51) Int. Cl.

| | |
|---|---|
| ***E02B 3/06*** | (2006.01) |
| ***E02B 3/10*** | (2006.01) |
| ***E01D 15/00*** | (2006.01) |

(52) U.S. Cl.

CPC ..... *E02B 3/102* (2013.01); *E02B 3/06* (2013.01)

(58) Field of Classification Search

CPC ..... E02B 7/14; E02B 7/40; E02B 8/06; E02B 3/06; E02B 3/10; E02B 3/102; E02B 3/104; E04H 9/14

USPC ..... 405/28, 31, 87, 99, 100, 107, 108, 110, 405/112, 114

See application file for complete search history.

(56) References Cited

U.S. PATENT DOCUMENTS

| | | | | |
|---|---|---|---|---|
| 1,392,414 | A * | 10/1921 | Hallee | E02L 37/205 405/100 |
| 5,211,700 | A * | 5/1993 | McClellan | E02B 7/46 405/101 |
| 6,196,764 | B1 * | 3/2001 | Bayssiguier | E02L 37/16 405/100 |
| 6,491,473 | B2 * | 12/2002 | Veazey | B63B 3/04 405/16 |
| 2005/0100411 | A1 * | 5/2005 | Rijlaarsdam | E02B 3/102 405/107 |

(Continued)

FOREIGN PATENT DOCUMENTS

| | | | | |
|---|---|---|---|---|
| DE | 20101549 U1 * | 6/2001 | | E02B 3/102 |
| EP | 1793043 A1 * | 6/2007 | | E02B 3/102 |
| IT | B-20090780 A1 * | 4/2011 | | E02B 3/104 |

*Primary Examiner* — Benjamin F Fiorello
*Assistant Examiner* — Stacy N Lawson

(57) ABSTRACT

A walkway including: a foundation base at least partially embedded in ground adjacent to a body of water; first and second supports, at least the first support being connected to the foundation base; a plank having a surface for use by pedestrians to travel along a shoreline, the plank having a first end rotatably connected to the first support and having a second end supported on the second support, the surface being exposed for use by the pedestrians when the plank is in a first position where the second end is supported by the second support, the plank having a length between the first and second supports; and a lifting mechanism operatively connected to the plank to rotate the plank from the first position to a second position where the length of the plank is oriented in a first direction to impede a rising height of the body of water.

13 Claims, 11 Drawing Sheets

(56) References Cited

U.S. PATENT DOCUMENTS

| | | | | |
|---|---|---|---|---|
| 2007/0189854 | A1* | 8/2007 | Forrest | E02B 3/102 405/107 |
| 2007/0237585 | A1* | 10/2007 | Frantz | E02B 3/102 405/107 |
| 2013/0343821 | A1* | 12/2013 | Obermeyer | E02B 3/102 405/114 |

* cited by examiner

BOARDWALK AND SIDEWALK SYSTEM WITH DUAL USE AS FLOOD CONTROL BARRIER

CROSS-REFERENCE TO RELATED APPLICATION

This application claims the benefit of U.S. Provisional Application No. 62/268,469 filed on Dec. 16, 2015, the entire contents of which is incorporated herein by its reference.

BACKGROUND OF THE INVENTION

1. Field of the Invention

The present invention relates generally to boardwalks used as pedestrian walkway, service vehicles and the like along oceans, lakes and rivers and the like, which can be readily turned into protective walls for flood control.

2. Prior Art

Boardwalks are constructed close to shore in many areas to provide pedestrians a walkway overlooking beaches. The boardwalks are also sometimes used by relatively light service vehicles, food carts, and the like.

Boardwalks are very popular with residents and visitors during good weather and particularly during summer times. Current boardwalks are constructed as a single purpose structure, namely to serve as a walkway for sightseeing, enjoying the weather, doing exercise, and the like, without having to encounter sand, dirt or mud or a rough terrain. Current boardwalks are also prone to damage from wind, hurricanes and flooding.

Boardwalks close to the shores are generally constructed by assembling planks made out of wood or synthetic materials over a constructed frame structure. In a typical plank deck assembly, decking planks are mounted to a deck frame in uniformly spaced apart relationship to allow surface water or rain to pass through the deck as well as to aid in ventilation. The spacing selected for use between the deck planks may vary depending on the type of materials used in construction as well as anticipated environmental conditions. Deck builders employ various implements to maintain uniformity in deck plank spacing, including wooden spacers, nails or specially made jigs. Some boardwalks are prevented from uplifting merely by their weight and some others are provided with certain anchoring foundation to resist wind and other natural uplifting forces.

Currently, boardwalks close to the shores are generally constructed by assembling planks made out of wood or synthetic materials over a constructed frame structure. An example of such structures of prior art is described in the U.S. Pat. No. 8,522,505 and as shown in FIG. 1. In such a boardwalk system construction, a plurality of piles or supports 12 are positioned on the ground surface over which the boardwalk to be installed. Each pile 12 is used to support one or more horizontally-extending beams 14 thereon. Each support 12 rests on the ground surface and elevate the beams 14 to the desired position above the ground. If desired, the beams 14 can be coupled to the associated support(s) 12 by any of a wide variety of coupling devices or systems. Each beam 14 supports a plurality of generally horizontally extending planks 16. This arrangement may however varied such that each plank 16 is supported by more than one beam 14, or by only a single beam 14, in which case the tread 16 may be supported at its other end by the earth or other structures. Generally, upper surface of each plank is flat and planar, and positioned relatively close to the upper surface of an associated plank 16 such that upper surfaces together define a generally smooth surface, usually with gaps between the planks 16, which can be walked upon, ridden upon by small vehicles and the like, etc. To make the boardwalk system more strong, each plank 16 may be coupled to an adjacent plank 16 by, for example, a laterally-extending tongue 15 received in an associated groove 17 in the adjacent plank 16. The supports 12, beams 14 and planks 16 can be made from any of a wide variety of materials, including, but not limited to, wood, wood composite materials or other composite materials, concrete, or materials made entirely or primarily of concrete. Modular decking systems having some features similar to that shown in FIG. 1 and described herein are disclosed in U.S. Pat. No. 5,906,084 to Millington et al. Each illustrated beam 14 may also include a plurality of pre-formed recesses 20 formed therein, formed in the outer surface thereof. Each beam 14, in the schematic of FIG. 1, includes four recesses 20 along its length. Each beam recess 20 may then be aligned with an associated plank recess 18 to together cooperate to form an opening 22 which can receive a connector 24 therein.

In almost all boardwalks, as discussed above, spacing is provided between the deck planks 16 depending on the type of materials used in construction as well as anticipated environmental conditions to allow for material expansion, to allow rain drainage as well as to provide for ventilation through the deck.

During storms and hurricanes or in the case of a Tsunami, the coastal areas require protection from flooding. Sea level rise due to global warming is increasing the frequency of coastal flooding, particularly in low lying and flat beach areas. Flooding protection is also needed on many river banks and lake shores when the water rises, for example, during long periods of heavy rains or during sudden warming of the weather after heavy snows.

Various types of barricades are used to protect coastal areas and floodplains from flooding. These are either permanent structures in the form of floodwalls, seawalls, dikes, and levees, or are temporary barricades such as sand bags or other portable barriers in various shapes, forms, and materials.

Permanent flood protection structures create a physical and visual obstruction to and from the waterfront, which makes them infeasible in populated low lying and flat beach areas where flood protection is most needed. Temporary flood protection structures have limited application, long response time, and entail significant effort and cost for deployment and later removal.

The construction of boardwalks as well as flood protection structures for coastal areas, lakeshores and riverbanks are costly. Flood protection is also usually needed only a few days in a year or even in a few years. It would therefore be highly advantageous if boardwalk structures could be designed such that they would double as flood protection structures. Such novel boardwalks must be capable of supporting the wind and wave and water loads when deployed as a flood protection structure. They should also be capable of being readily deployed and withstand the harsh and corrosive environment of seashore.

It is appreciated by those skilled in the art that events such as hurricanes produce large waves, winds as well as high speed gusts. It is therefore important for the boardwalks to be capable of not only withstanding the generated waves, raised water levels and winds, but be also capable of withstanding gusts, which are sometimes significantly higher in speed than the wind levels.

SUMMARY OF THE INVENTION

A need therefore exists for boardwalks that could double as flood protection structures, thereby providing the means for people to enjoy the seashores and riverbanks, while at the same time protecting the shores, residential areas and surrounding lands from flooding when the need arises. Such a boardwalk structure has the great advantage over any permanent structure since it would not create a permanent physical and visual obstruction to and from the waterfront.

Such dual purpose boardwalks must be capable of withstanding the floodwater pressure, wave impact, wind and gusts that usually accompanies hurricanes when employed along the seashores. As a result, such dual purpose boardwalks must be capable of withstanding such events without requiring highly elaborate and costly moving and support structures.

In addition, the design of such dual use boardwalks must be relatively simple, easy to operate, and be capable of being deployable manually since in situations such as during hurricanes or flooding there is no guarantee that there would be access to electrical power. Simple designs would also translates to lower cost of construction and installment, which would enables their widespread application, particularly considering the effects of global warming that has resulted in more frequent and stronger flooding conditions.

A need therefore exists for boardwalks that could double as flood protection structures that are provided with novel mechanisms that allow their rapid and easy deployment. The deployment mechanisms are preferably capable of being operated manually as well as by externally powered actuation devices such as electrical motors and gears or hydraulic or pneumatic devices.

A need therefore also exists for practical and cost effective means of flood protection that does not create a permanent physical and visual obstruction to and from the waterfront, has wide ranging application in flood protection, and does not entail significant effort and cost for deployment.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Figure 1:
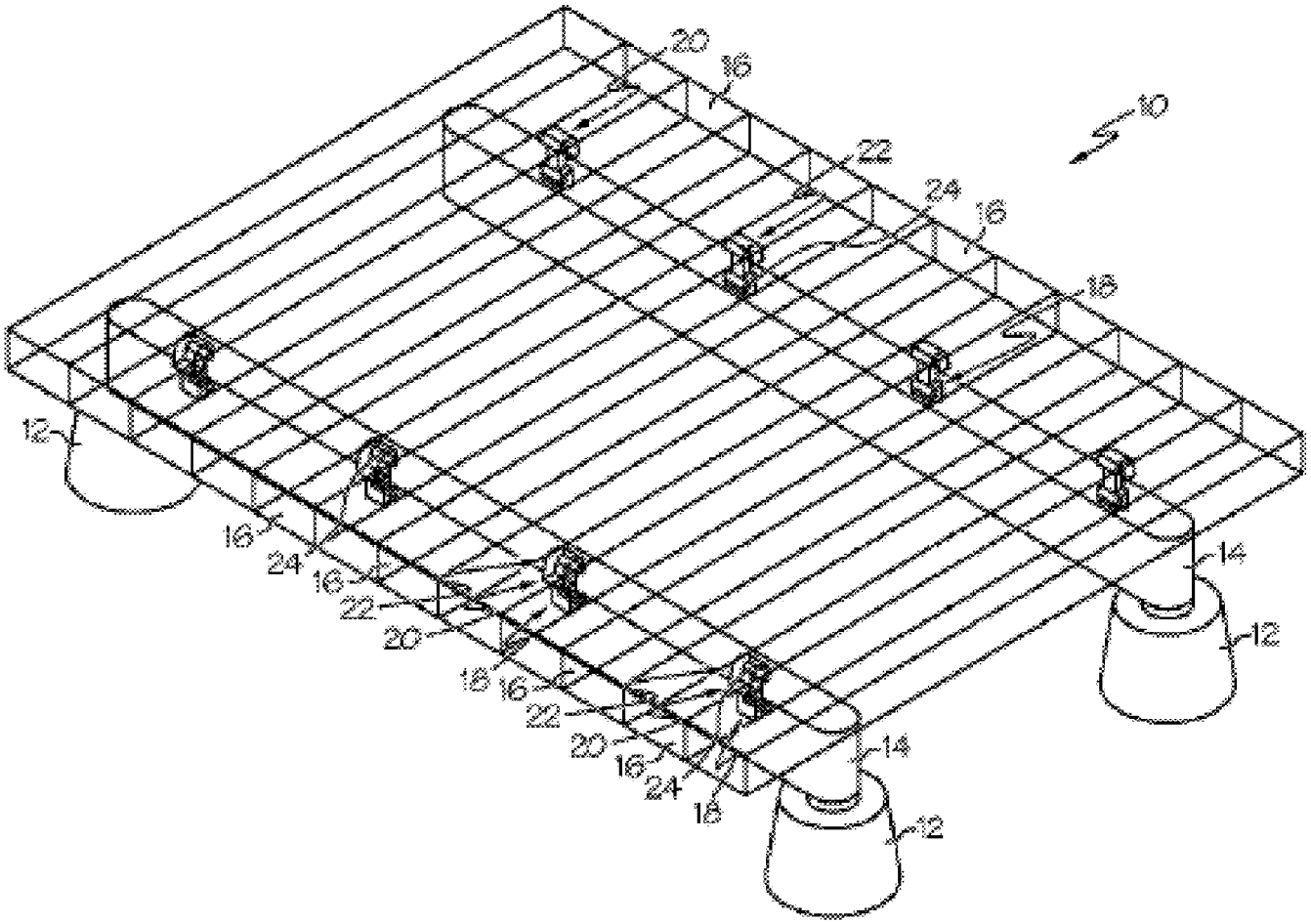
Figure 1 (PRIOR ART)
FIG. 1 illustrates the construction of a typical boardwalk of the prior art that is currently being widely used with or without certain modifications.
Figure 2:
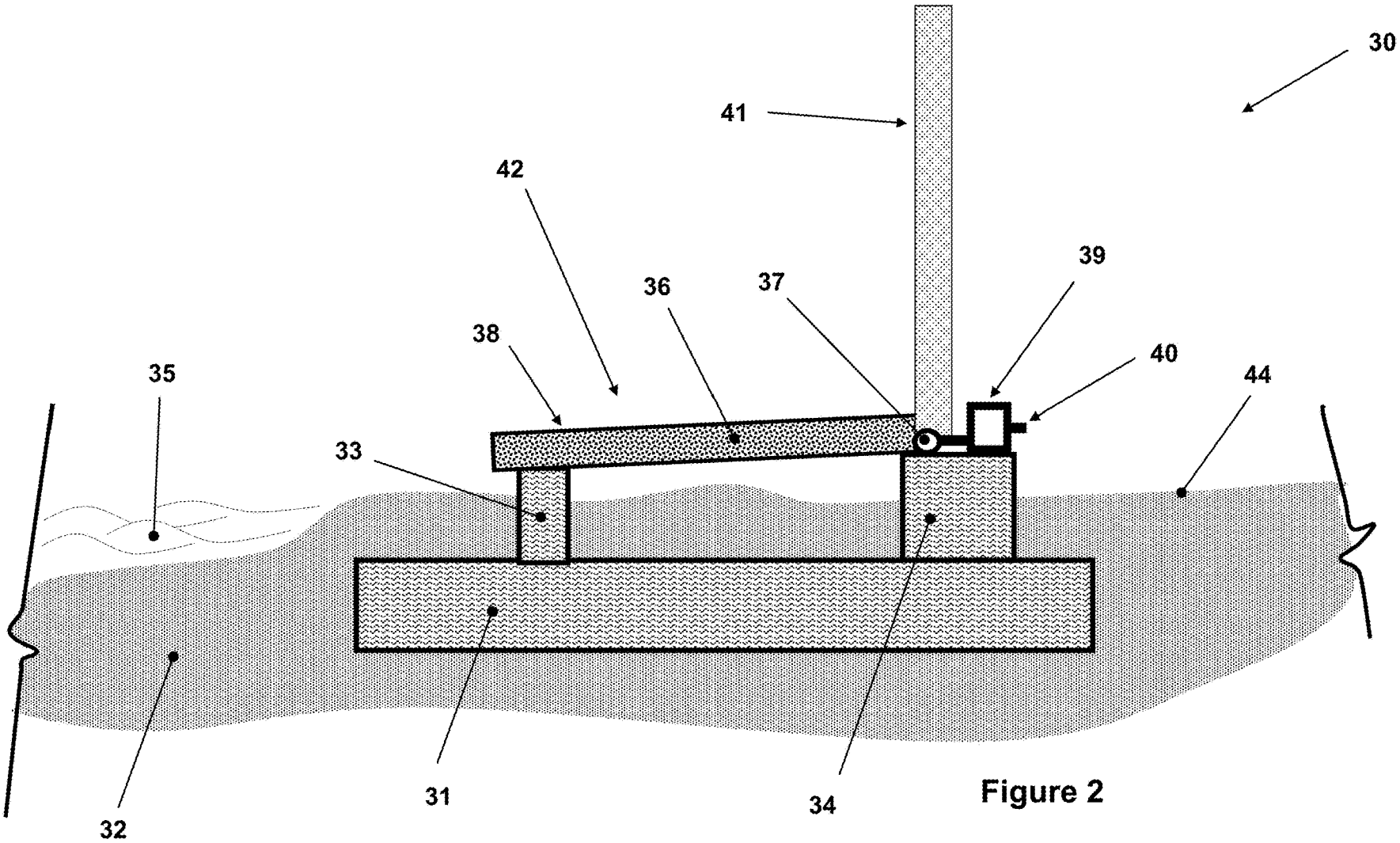
FIG. 2 illustrates the schematic of the first embodiment of the dual use boardwalk that can be turned into a flood barrier of the present invention.

A first embodiment of a dual use boardwalk that can be turned into a flood barrier of the present invention is described using the schematic of FIG. 2, generally referred to by reference numeral 30. Although referred to herein as "boardwalks," other types of walking surfaces, such as sidewalks and walkways are also applicable where such terms are used interchangedly to encompass all walking surfaces. FIG. 2 shows the cross-sectional view of the embodiment 30 as installed at a beach or the like area. In FIG. 2, only the basic components of this embodiment is shown for the sake of clarity and other necessary and optional or variations of this basic embodiment is presented below.

The embodiment 30 shown in FIG. 2 consists of a foundation base 31, which can be made out of reinforced concrete, which can be at least partially embedded in the beach (ground) area sand or soil 32, close or certain distance from the water 35 or potential flood area. The foundation based 31 may be a continuous slab if needed considering the type and characteristic of the soil/sand, but can also be made out of interconnected concrete structures that would provide the required "lifting" resistance to counter the forces of flood water, wave and wind gusts that the attached flood barrier could be subjected to during a storm as is later described. Over the foundation base 31 are provided with a series of at least two rows of support stands 33 and 34. At least the support stands 34, and possibly both support stands 33, 34, can also be made out of concrete with strong reinforcement and can be integrally formed with the structure and reinforcement elements of the foundation base 31. In this embodiment, planks 36 are attached to the one row (preferably the outer row 34) supports via a hinge joint 37. In the configuration shown with solid lines and indicated by the numeral 36, the plants 36 rest against the opposite row (such as the row 33 closest to the water 35) of supports. In the configuration indicated by the numeral 42, the planks 36 serve as a boardwalk, with a relatively smooth surface 38, which can be walked upon, ridden upon by small vehicles and the like, etc. In this configuration, the top surface 38 of the planks 36 are can be sloped slightly downward in the direction of the water 35 to allow rain and other fluids such as those used to wash the surface to drain and not collect over the surface of the boardwalk.

At the hinge 37, the planks 36 are fixedly attached to the hinge shaft (not shown) which is in turn attached via a coupling and can include a gearing box 39 (to be described in more detail below) to an input shaft 40. The hinge shaft (43 in FIG. 3) can be welded to reinforcing steel structures that are embedded in the composite plank for strength purposes to enable the plank to withstand wind gust and flood water and wave pressure. The gearing box 39 is coupled to the aforementioned hinge shaft such that as the input shaft 40 is rotated by an external means, the hinge shaft is rotated to raise the plank 36 to its configuration indicated by the numeral 41. As a result, the boardwalk (planks in the configuration 42) are turned into flood barriers that would protect the areas behind the boardwalk when the water 35 surges above its normal high levels.

The planks 36 can be long (in the direction parallel to the beach, i.e., perpendicular to the cross-sectional view of FIG. 2), for example 10-20 feet long, and made without any openings so that when deployed as a flood barrier configuration 41, water cannot pass through the planks. The space between two adjacent planks can be very small, in which case sealing members can be provided as described below to prevent water from flowing through the gap between the planks. The planks may be constructed from many different light weight but strong and tough materials to resist impact type loading due to gusts and water splashes due to high waves. Such materials can include composite materials such as those containing recycled plastics with high strength fibers provided to provide high strength, particularly in bending due to water and wind pressure.

Figure 3:
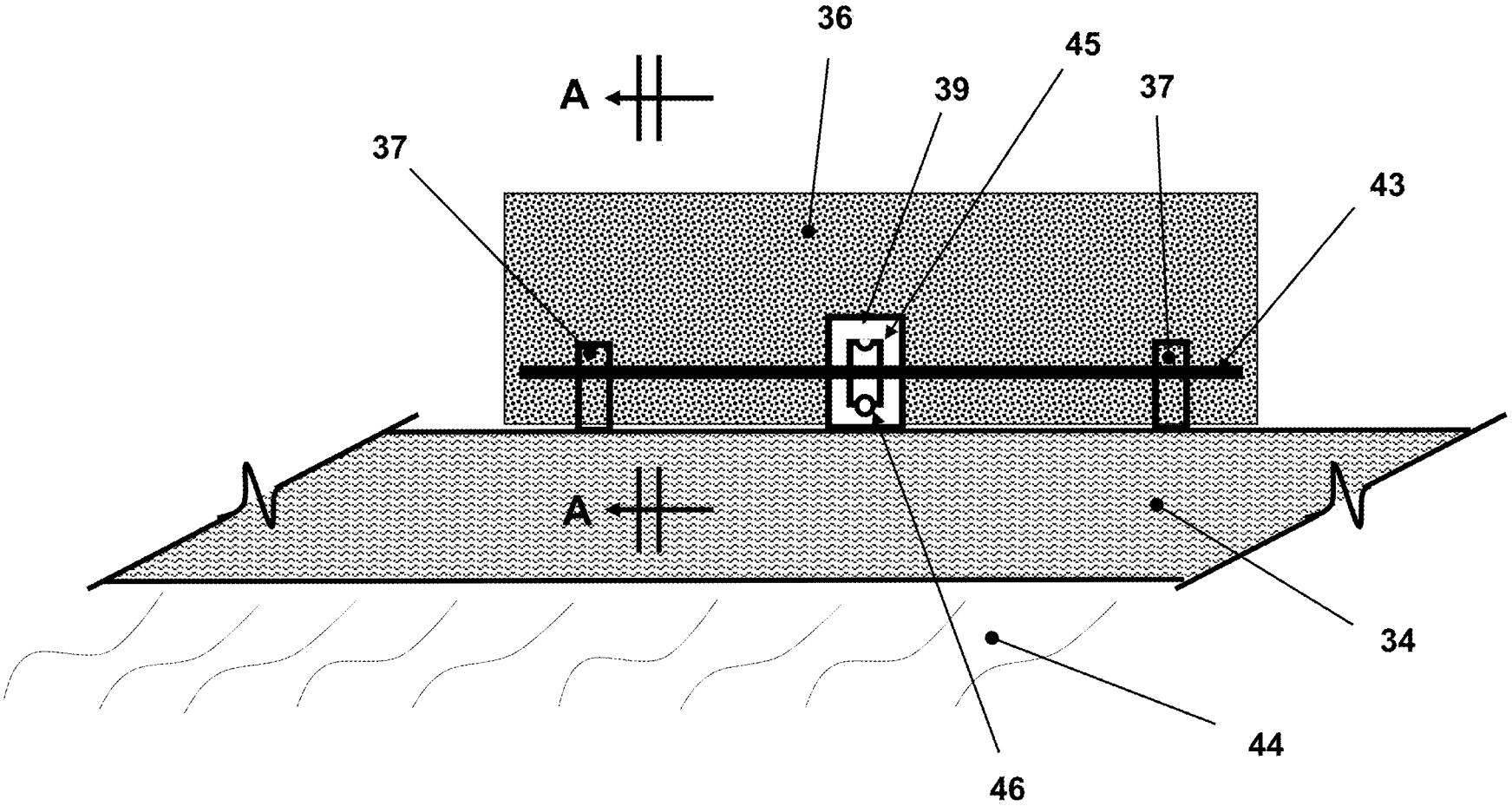
FIG. 3 illustrates the schematic of a boardwalk raising gearing, mechanical coupling and input drive.

A typical gearing mechanism 39 that can be used for raising the boardwalk planks from configuration 36 to their flood control configuration 41 is shown in the schematic of FIG. 3. In this embodiment, the shaft 43, which is fixedly attached to the plank 36 is fixed to the continuously provided support stands (wall) 34 via at least two (or more) hinges 37. The base of the hinges 37 can be attached to the support wall 34 through reinforcing structures provided in the concrete structure of the support wall 34 such that they could withstand the forces of the flood water, waves and wing gust. The mechanism for raising the boardwalk 36 to its flood wall configuration 41 consists of the gearing mechanism 40 (FIGS. 2 and 3), which can comprise a worm gear type or the like mechanism. In such a type of gearing mechanism, the gear component 45 of the worm gear couple is fixedly attached to the shaft 43 for to affect its rotational motion during the raising process to its flood wall configuration 41 as well as during its lowering to its boardwalk configuration 36. The worm element 46 is in turn attached to the output shaft 40 (FIG. 2) directly or via a coupling element (not shown). The worm gear may also be provided with further reduction gearing (not shown) within the gear box as is well known in the art to further reduce the level of required input torque for its raising. The plank 36 may also be provided by counterweights (not shown) to further reduce the level of required raising torque.

When the need arises, the operator (possibly a park ranger or the like) can bring a truck equipped with a high torque motor such as those commonly used in truck winches over the side 44 of the boardwalk 30 structure and connects the output shaft of the motor to the input shaft 40 of the gearing 39 by a drive shaft (which can be provided with double u-joints), FIGS. 2 and 3. The plank 36 is then raised to its flood protecting configuration 41 by the aforementioned high torque motor. It is also appreciated by those skilled in the art that by providing proper balancing counterweights and by providing a high enough gear ratio in the gear mechanism 39, the operator would then be able to raise and lower the plank manually by engaging a driving wheel or handle to the input shaft 40 to achieve proper leveraging. It is also appreciated by those skilled in the art that gearing system 39 may also be directly coupled to electrical motors (not shown) which are turned on by the operator (remotely if desired) to similarly raise and lower the planks.

Figure 4B:
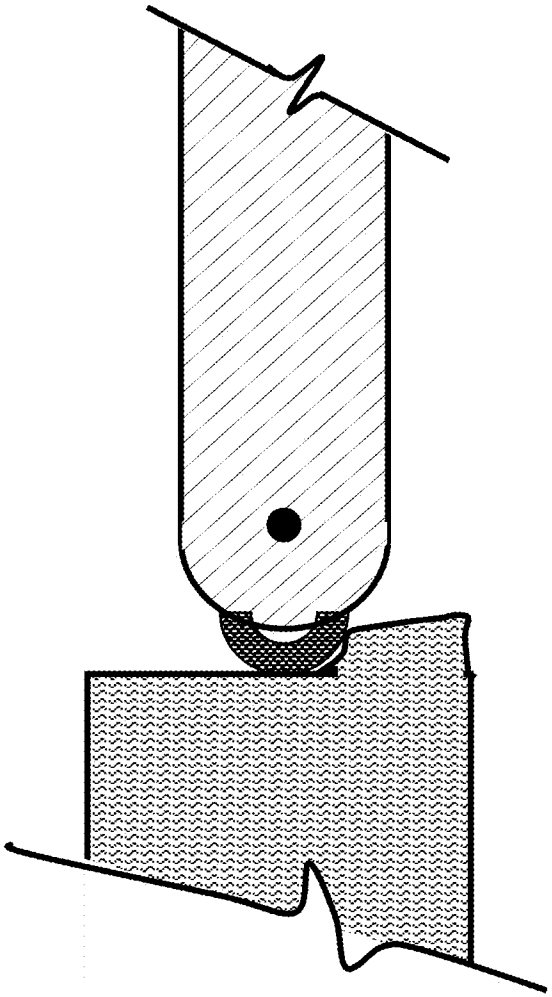
FIGS. 4A and 4B illustrate the schematic of the method and means of closing the gap between the boardwalk of the embodiment of FIG. 2 and its support wall after it is deployed as a flood barrier wall.
Figure 4A:
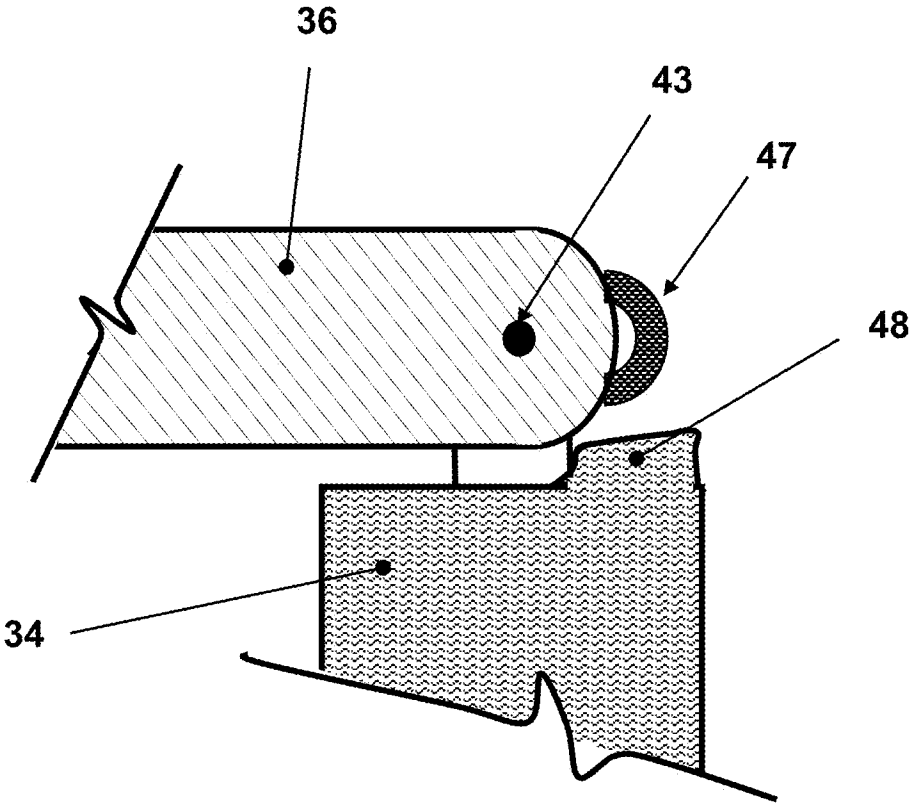

Once the boardwalk planks 36 have been raised to the configuration 41, the gap between the plank 36 and the support wall 34 is closed and sealed by the provided relatively elastic member 47, FIG. 4A, which can be constructed with salt and water resistant and relatively hard synthetic elastomeric materials. The elastic member 47 can be shaped so that it deforms to close the aforementioned gap while elastically deformed as the planks 36 are raised, preferably as shown in the schematic of FIG. 4B or the like. During raising of the planks 36, the elastic member can be wedged against a curved top surface of the support wall 34, so that the water pressure would tend to further increase its resistance in closing the gap. It is appreciated by those skilled in the art that there are many other methods and means known in the art for closing the gap between the plank 36 and the support wall 34 and sealing it. The aforementioned method and means illustrated in the schematics of FIGS. 4A and 4B is not intended to exclude any other method and means known in the art.

Figure 4C:
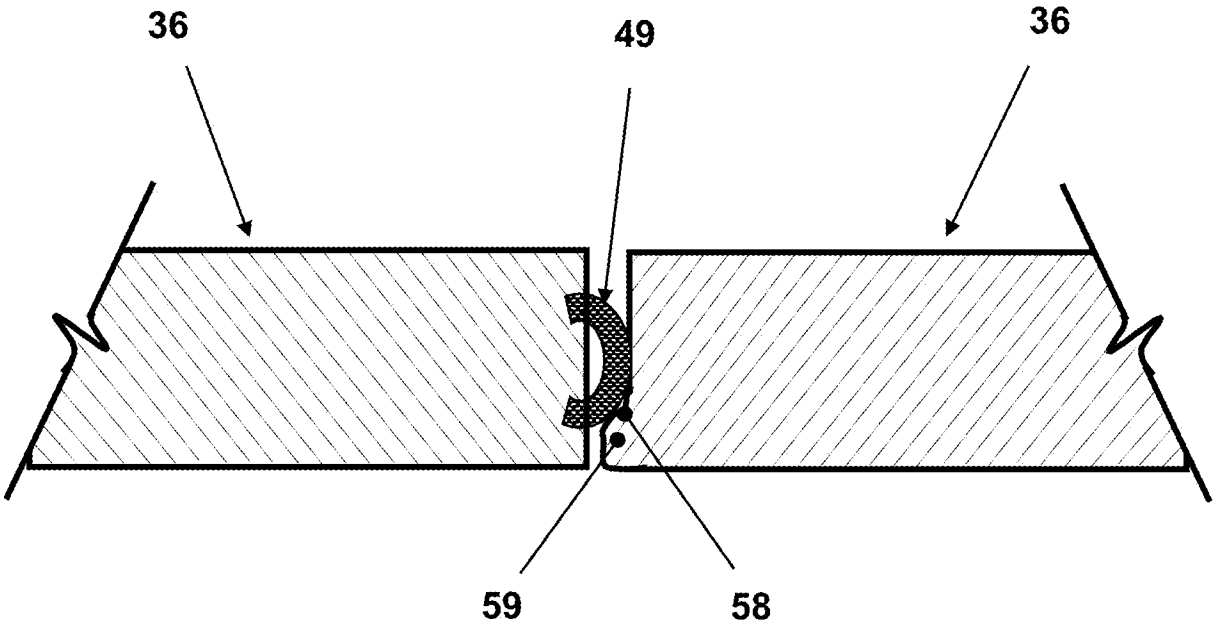
FIG. 4C illustrate the schematic of the method and means of closing the gap between the boardwalk planks while they are deployed as a flood barrier wall.

Any gap between boardwalk planks 36 can be similarly closed using shaped elastic members as shown in the cross-sectional view of FIG. 4C. Once the boardwalk planks 36 have been raised to the configuration 41, FIG. 2, the gaps between the planks 36 are also closed and sealed by the provided relatively elastic member 49 (similar to 47 in FIG. 4A), can be constructed with salt and water resistant and relatively hard synthetic elastomeric materials. The elastic member 49 can be shaped so that as an adjacent plank 36 is raised, it deforms to tightly close the gap between the planks. The elastic member 49 can be shaped to wedge against the curved surface 58 of the side extension 59 provided on the side of a mating plank as shown in FIG. 4C. As a result, water pressure would tend to further increase the resistance of the sealing effect of the elastic member 49. It is appreciated by those skilled in the art that there are many other methods and means known in the art for closing the gap between the planks 36. The aforementioned method and means illustrated in the schematic of FIG. 4C is not intended to exclude any other method and means known in the art.

Figure 5:
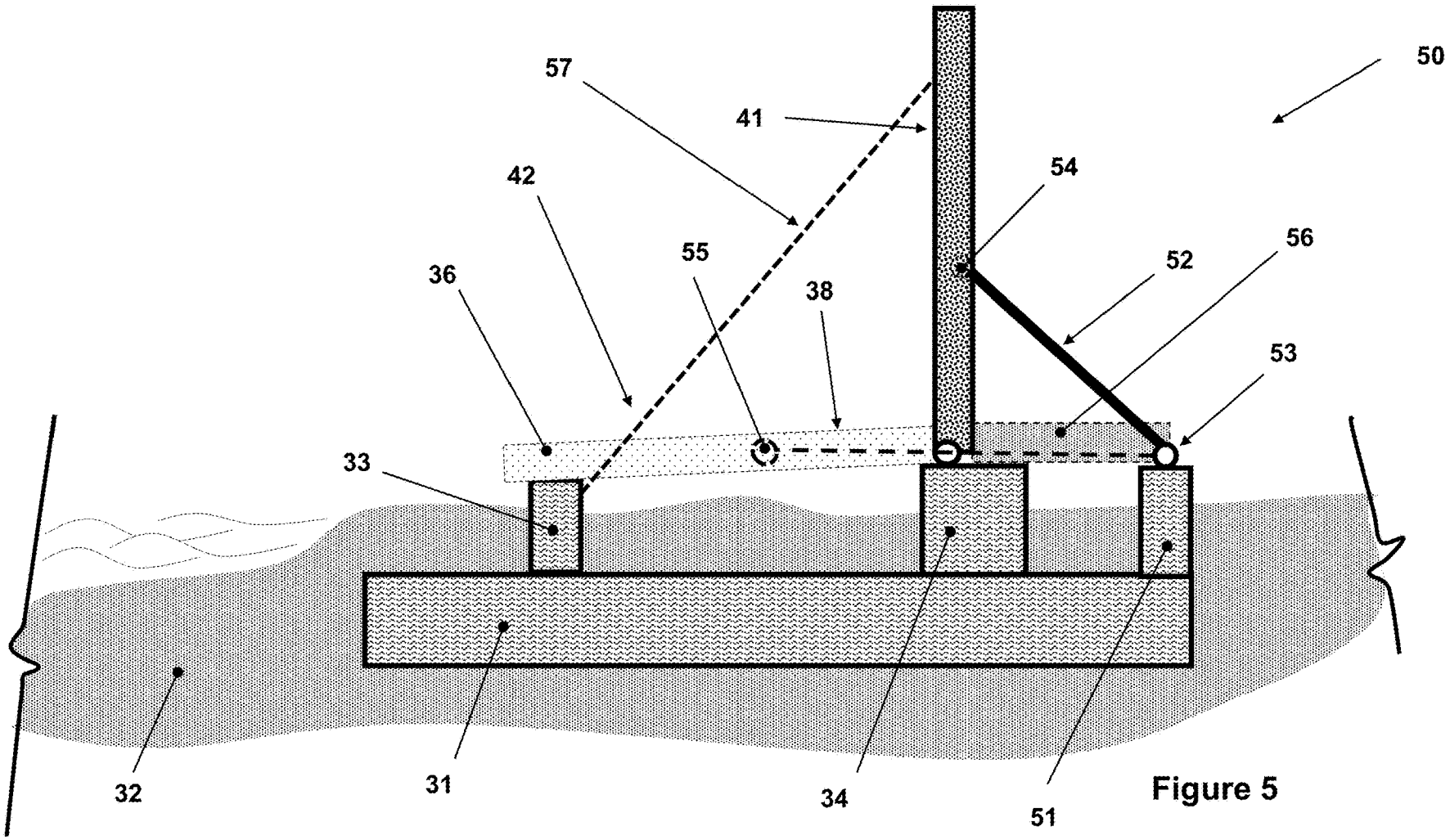
FIG. 5 illustrates the schematic of an alternative design of the first embodiment of the dual use boardwalk of FIG. 1 for increasing its resistance to the wind gust, wave and flood water once it is deployed as a flood barrier wall.

An alternative embodiment of the first embodiment 30 (FIG. 2) is shown in the schematic of FIG. 5 and generally referred to by reference numeral 50. The embodiment 50 is intended to provide additional support to the planks 36 while it is deployed to its configuration 41 to serve as a flood barrier. Such additional structural supports are best designed to support the deployed planks 36 in bending (backward) against the forces of waves and flood water and wind gust against both sides of the plank panels. One such support structure may consist of at least one telescopic support member 52, which is attached to an additional support structure 51 via a hinge joint 53 on one end and to the plank 36 via another hinge joint 54 on the other end. The support member 52 is constructed by two telescopically mating, such as box-type, members in which one can ride inside (or against) the other. As a result, the support member 52 can accommodate the increase in its length (from the joint 53 to the joint 54) as the plank 36 is moved down from its configuration 41 to its boardwalk configuration 42. The plank 36 is provided with a groove to accommodate the support member 52 while serving as a boardwalk keeping the upper surface of the support member 52 flush with the upper surface 38 of the plank 36. The telescopic support member 52 is provided with a stop so that as the plank 36 reaches its flood barrier configuration 41, the inner portion of the telescopic support member bottoms out and the support member can fully support high compressive loads. The telescopic support member 52 may also be provided with locking members (not shown) that are either provided by the system operation—for example by inserting locking pins to lock the two members of the support member 52 together or may be provided with spring loaded locking pins that are automatically engaged upon deployment of the planks as flood barriers. It is appreciated that such locking mechanism are desired to be provided so that after the planks are deployed to their configuration 41 and before any flood water has risen to apply pressure onto the plank surfaces, the planks 36 may be subjected to wind gusts from either side, which requires the planks 36 to be supported against being forced in the direction of it boardwalk configuration 42.

Similar to the support wall 34 and support stands 33, the support structure 51 can also be made out of concrete with strong reinforcement and can also be formed integrally with the structure and reinforcement elements of the foundation base 31.

It is appreciated by those skilled in the art that in general more than one such support member 52 is desired to be used for each plank 36, such as one every few feet, and that they have to be sized to support the maximum flood water, wave and wind gust forces. It is also appreciated that many other types of support members known in the art may also be used instead of the present telescopic member. In general, such supports are desired to be self-deployable, but may also be deployable by the system operator. In addition, multiple types of such supports, some relatively rigid such as the support member 52, and some made out of cables 57 (shown with a dashed line) attached to the support 33 on one end and to the bottom side of the plank on the other end, may also be used. Such support cables are intended to support the deployed plank in tension, and as such needs to be tightly set once the plank is deployed to its configuration 41.

In its boardwalk configuration 42 illustrated in FIG. 5 the support member 52 will be exposed between the support wall 34 and the supports 51. In one alternative embodiment, plank members 56, which are similar to the planks 36, are used to bridge the distance between the supports 34 and 51. Here again gaps are provided in the plank 56 to accommodate the support member 52, as was previously described for the plank 36. As a result, the gap between the supports 34 and 51 is covered and the total width of the boardwalk is also increased.

Figure 6:
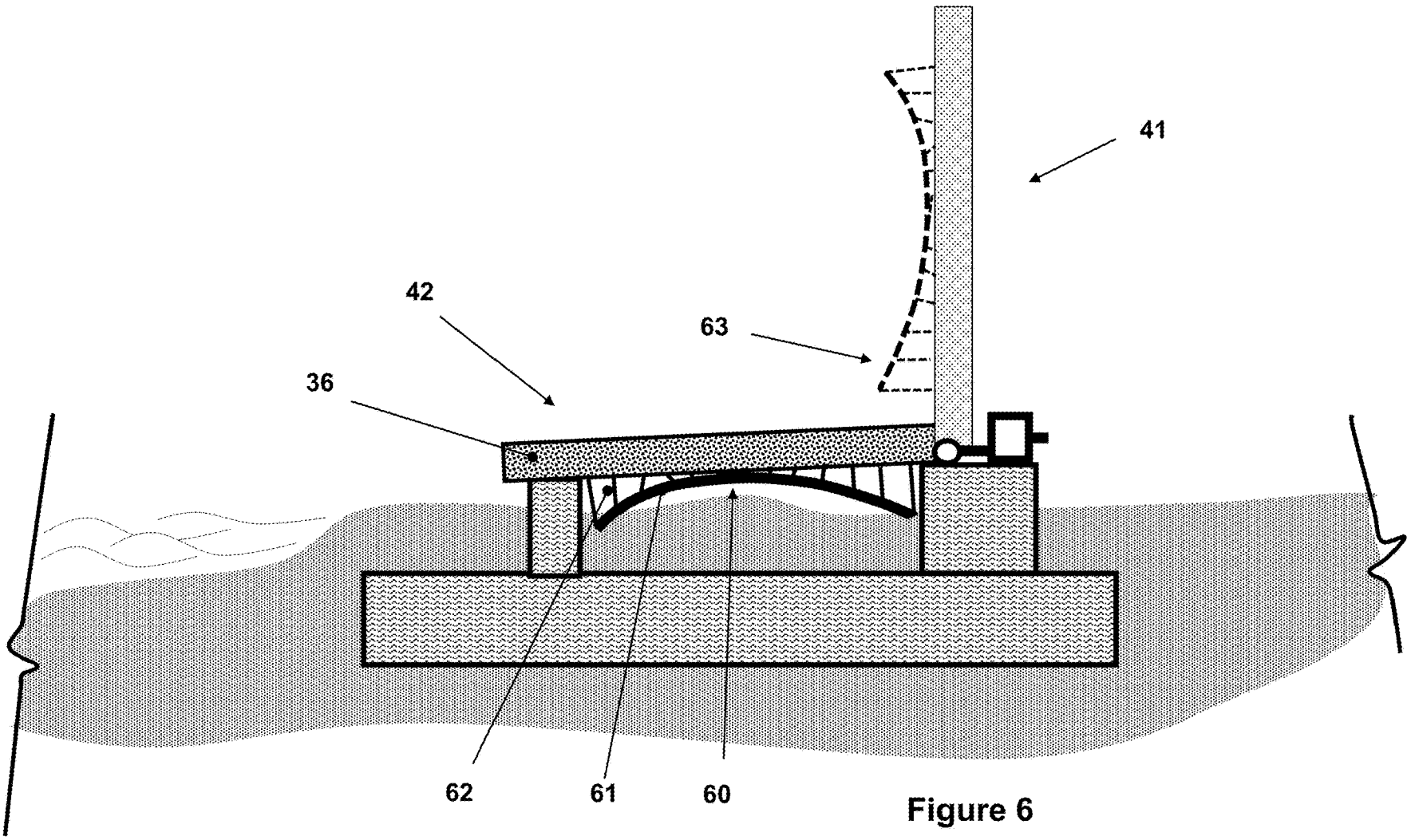
FIG. 6 illustrates the first embodiment of the dual use boardwalk that can be turned into a flood barrier of FIG. 2 with the boardwalk planks provided with wave reflecting surfaces.

In the embodiments of FIGS. 2 and 5, the bottom surfaces of the planks 36 (the flood water facing of the deployed flood wall) are shown to be flat. In an alternative embodiment of the dual use boardwalk that can be turned into a flood barrier, a flood water facing surface of the flood wall, i.e., the bottom surface of the planks 36, can be provided with curved surfaces 60. The surface 60 can be integrally formed with the planks 36, but may also be constructed by frontal curved plates 61 using salt and water resistance materials such as those used in the construction of the planks 36 themselves and are connected by connecting members 62 to the bottom surface of the planks 36. Then when the planks 36 are raised from their boardwalk configuration 42 to their flood wall configuration 41 as shown in FIG. 6, the curved surfaces 60 (drawn by dashed line in the flood wall configuration 41 and indicated by the numeral 63) face the flood water and incoming waves. The curved surfaces 63 can then reflect the incoming waves back away from the flood wall, thereby minimizing the flow of splashing wave water over the flood wall to the protected side of the wall.

In many strong storm and/or hurricane conditions, sudden high speed wind gusts or high waves may occur several times over relatively long periods of time. Since such events occur a limited number of times over the course of a strong storm and/or hurricane conditions, instead of building very tall and very strong flood walls that could withstand relatively short duration and infrequently occurring peak gust speeds and wave splashes at relatively high costs, a more flexible embodiment shown in the schematic of FIGS. 7A and 7B may be employed. In this embodiment, safety gates 66 are provided that would open up when they experience pressures above certain threshold to let the wind gust and/or wave water through the flood wall for a very short period of time until the imparted pressures subsides. It is appreciated by those skilled in the art that in almost all strong storms and hurricanes, such very high peak wind gusts and wave splashes occur very infrequently, and thereby the resulting infrequent and short duration passing of wind gusts and very limited amount of passage of flood water will have minimal effect on the otherwise protected area behind the flood wall.

Figure 7B:
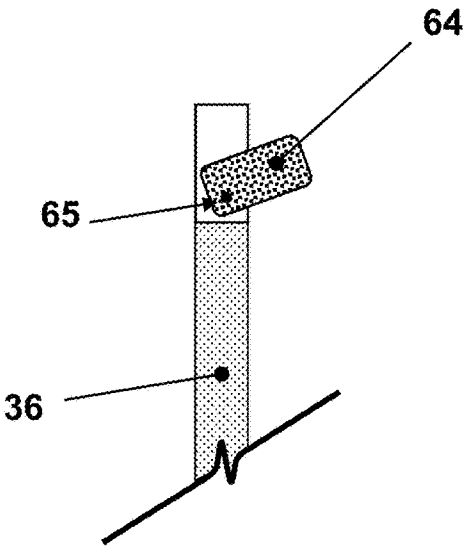
FIGS. 7A and 7B illustrate the provision of high wind gust and/or wave splash safety gates provided to prevent damage to the flood wall of the embodiment of FIG. 2 due to infrequently occurring and relatively short duration peak wind gusts and wave splashes.
Figure 7A:
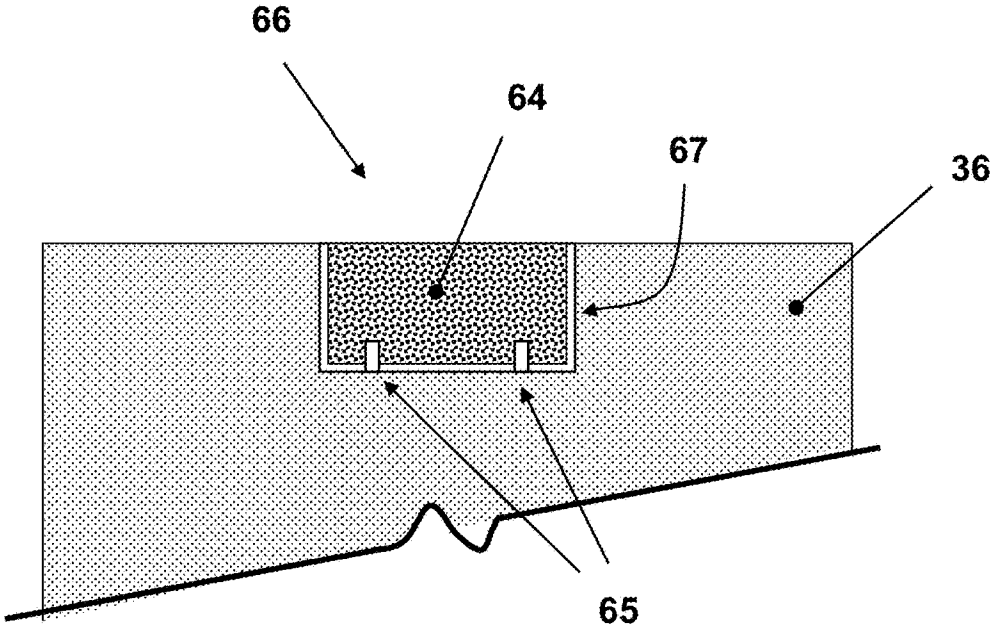

In the schematic of FIG. 7A, the aforementioned very high wind gust and/or very strong wave splash safety gate sections 66 are shown to be provided along the top portion of the planks 36 (top portion of the flood wall). The safety gates 66 can be positioned on the top section of the flood wall as shown in FIG. 7A to minimize the bending moment on the plank 36 and reaction torque at the plank joint 37, FIG. 2. Each safety gate 66 comprises the panel 64 (which can be made out of the same material as the plank 36), which is mounted in a cut-out opening 67 in the plank 36 by rotary joints 65 so that the panels 64 could rotate back as shown in FIG. 7B when subjected to pressure from the water side of the flood wall. Preloaded spring elements (not shown), such as torsional springs acting at the joints 65, can be provided to bias the panels in the opposite direction and against stops (not shown) provided inside the opening 67 to keep the panel flush on the boardwalk side with the surface 38 (FIG. 2) of the boardwalk. Then if the wind gusts from the water side or wave pressure reaches above the prescribed threshold level of the preloaded safety gate 66, then the safety gate panel 64 swings open momentarily as shown in the cross-sectional view of 7B, to allow the peak wing gust and/or wave splash to pass through, thereby protecting the flood wall structure. The safety gate will then automatically close after the pressure acting on the panel 64 drops below the said threshold.

Figure 8:
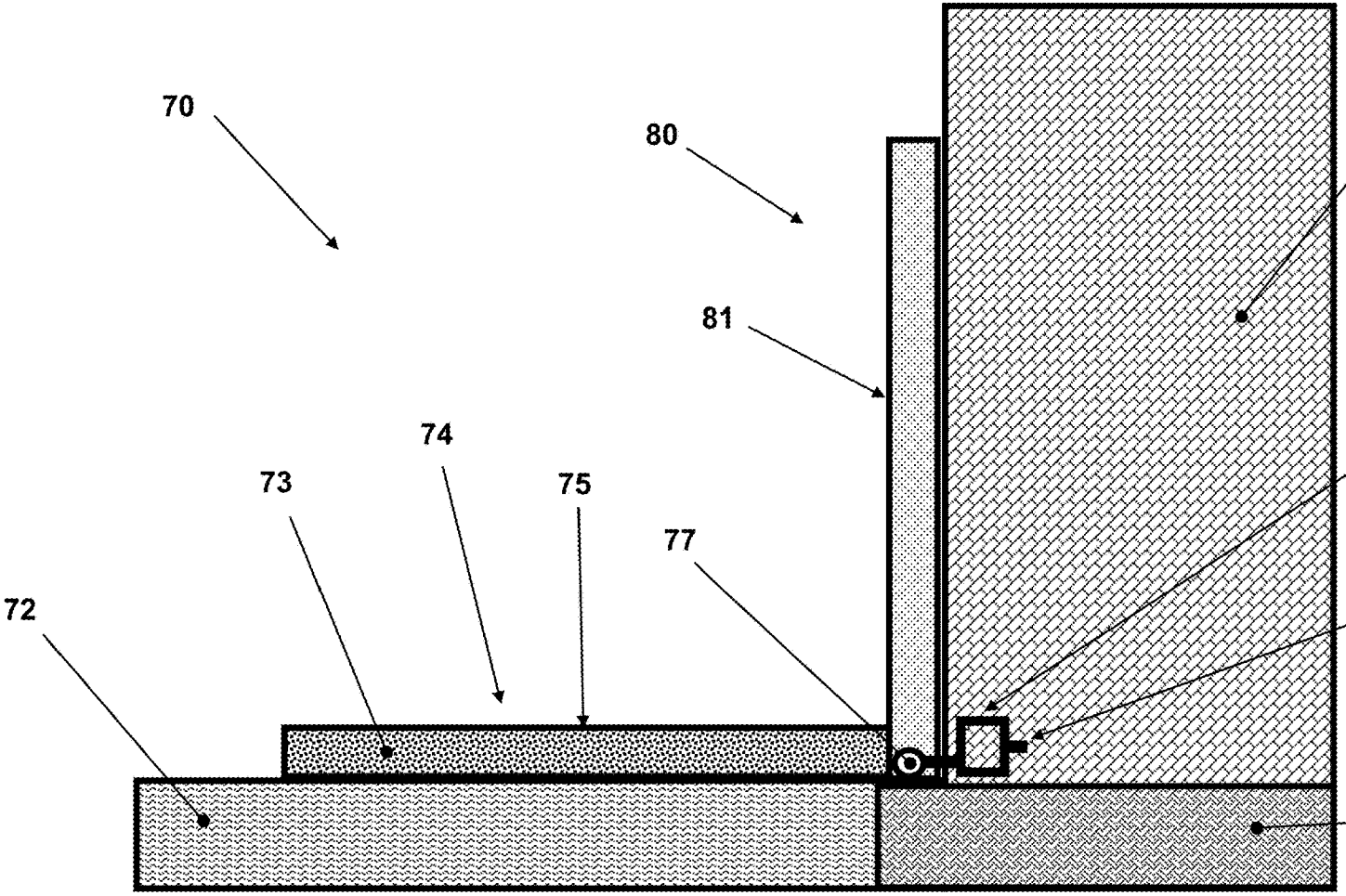
FIG. 8 illustrates the schematic of the embodiment of the dual use sidewalk that can be turned into a flood and object/debris impact barrier of the present invention.

The embodiment 70 shown in the schematic of FIG. 8 is a dual use sidewalk which may be used around buildings or alongside of roads or the like, which can be turned into a flood barrier or to protect a building or the like against flying objects and debris during storms and hurricanes and the like. FIG. 8 shows the cross-sectional view of the embodiment 70 as installed as a sidewalk in front of a building 71. In FIG. 8, only the basic components of this embodiment is shown for the sake of clarity and other necessary and optional or variations of this basic embodiment is presented later in this disclosure.

The embodiment 70 shown consists of certain pavement structure 72, over which the sidewalk planks 73 rests. In the sidewalk configuration 74, the planks 73 are shown with solid lines. In the configuration 74, the planks 73 serve as a sidewalk, with a relatively smooth surface 75, which can be walked upon or ridden upon by bicycles and the like, etc. In this configuration, the top surface 75 of the planks 36 can also be sloped slightly downward in the direction of allowing rain and washing water, etc., to flow towards the sidewalk drainage.

The sidewalk planks 73 can be attached to the foundation 76 of the building 71 via hinge joints 77 (similar to hinge joints 37 and the plank attached shaft 43 as shown in the schematic of FIG. 3). The supports of the hinge joints 77 can be rigidly attached to the concrete foundation 76 of the building 71 via reinforcing elements of the concrete foundation for increased load bearing. The hinge 77 shaft (not shown—but similar to 43 in FIG. 3) is also rigidly attached to the planks 73, such as via reinforcing elements as was described for the planks 36 of the embodiment of FIG. 2. The hinge 77 shaft is in turn attached via a coupling, which could include a gearing box 78, to the input shaft 79 (similar to the gearing mechanism 39 of the embodiment of FIG. 2). Similar to the gearing box 39 of the embodiment of FIG. 2, the gearing box 78 is coupled to the aforementioned hinge shaft such that as the input shaft 79 is rotated by an external means, the hinge shaft is rotated to raise the plank 73 to its flood wall and object/debris impact protection configuration 80. As a result, the sidewalk (planks in the configuration 74) are turned into flood and flying object/debris barrier that would protect the building.

The planks 73 can be wide (in the direction of the sidewalk), for example 10-20 feet wide, and made without any openings so that when deployed as a flood barrier configuration 80, water cannot pass through the planks. The space between two adjacent planks can be very small and sealing members can be provided as was described for the embodiment of FIG. 2 as shown in FIG. 4C. Any gap between the planks 73 and the building foundation is also sealed, such as was described for the embodiment of FIG. 2 as shown in FIGS. 4A and 4B. The planks may be constructed from many different light weight but strong and tough materials to resist impact type loading due to gusts and objects/debris impact and flood water splashes. Possible materials include generally composite materials such as those containing recycled plastics with high strength fibers provided to provide high strength and tough. The surface 75 of the planks 73 may also be covered by asphalt or tiles or concrete based layers for pedestrian traffic and the like.

The mechanism for raising the planks from their sidewalk configuration 74 to flood and object/debris barrier 80, FIG. 8, can be as was described for the embodiment of FIG. 2 and shown in FIG. 3. When used as such a barrier for buildings, an electric motor (not shown) positioned together with the gearing 78 inside the building can be used to deploy the planks 73 to its configuration 80. An electric motor can be provided with reduction gearing to minimize its size since barrier deployment does not need to be very rapid. In addition, the electric motor may be of double shaft type, so that in case of power outage the operator could attach a handle or wheel to the exposed shaft and rotate the rotor to slowly deploy the barrier.

Figures 9, 9A, 9B:
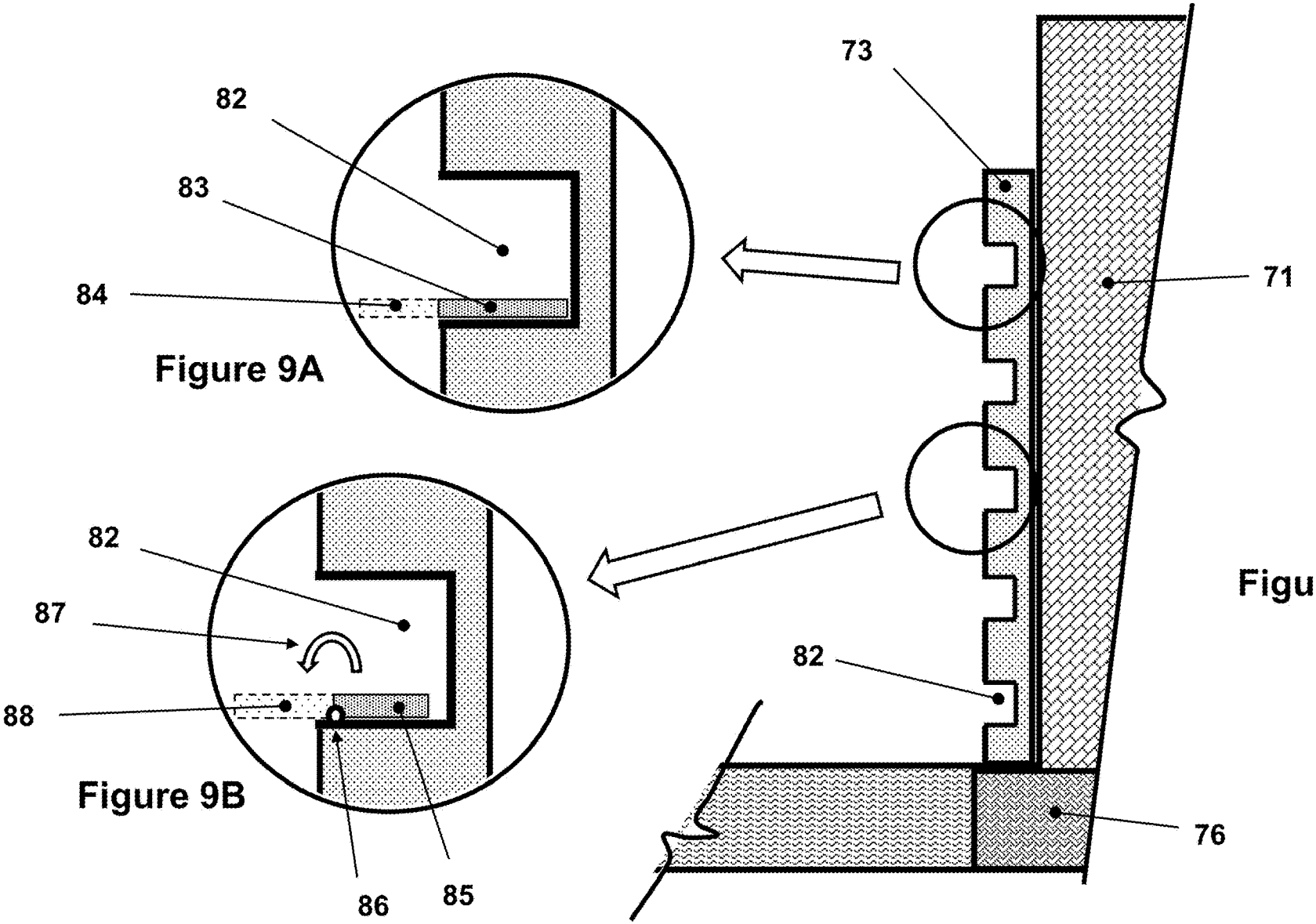
FIGS. 9, 9A and 9B illustrate methods of providing the means of climbing the exterior surface of a sidewalk that has been deployed as flood and object/debris impact barrier for exiting or entering the protected building.

It is appreciated by those skilled in the art that in the case of flood or high wind and gust threats, the sidewalk planks all around the building (or the exposed side of the building) are raised to protect the building from flooding and/or flying objects and/or debris due to high winds and gusts. In such cases, at least one of the planks can be provided with steps 82 which are built into the outside facing side 81, FIG. 8, as shown in the schematic of FIG. 9. Each step 82 may also be provided with outward sliding steps such as the one shown in the blow-up view of FIG. 9A. In the blow-up view of FIG. 9A, the outward sliding step 83 is shown in its stored position and its deployed position 84 to provide large enough step surface area for a user to enter or exit the building 71. Appropriate guides and stops commonly used in such mechanisms (not shown) are considered to be provided. Alternatively, as it is shown in FIG. 9B, the step platform 85 is attached to the plank 71 inside the step opening 82 by a hinge 86 and is rotated in the direction of the arrow 87 to be deployed to its outward position 88 against a stop (such as the opening 82) to keep it in the shown position 88. The sliding step 83 and the rotating step 85 can also be locked in their stored position and deployed as the need arises. It is also appreciated that either deployment options or their combination may be provided so that people could climb up into the building through, e.g., a window or other openings, or exit the building without requiring the barrier to be lowered.

It is appreciated by those skilled in the art that many other relatively safe options may also be provided for people to climb into the building or exit it. For example, the aforementioned step openings 82 alone may be provided together with handles (not shown) attached to the sides of the steps 82 (such as being attached inside provided cavities so that they do not protrude beyond the surface 81 of the plank 73) so that the user can easily climb the surface using the step openings while holding on the handles. Alternatively, a deployable ladder (not shown) may be provided and embedded into a provided cavity on the side 81 of one or more plank, and which could be swung out and deployed for the same purpose as the aforementioned steps.

Figure 10:
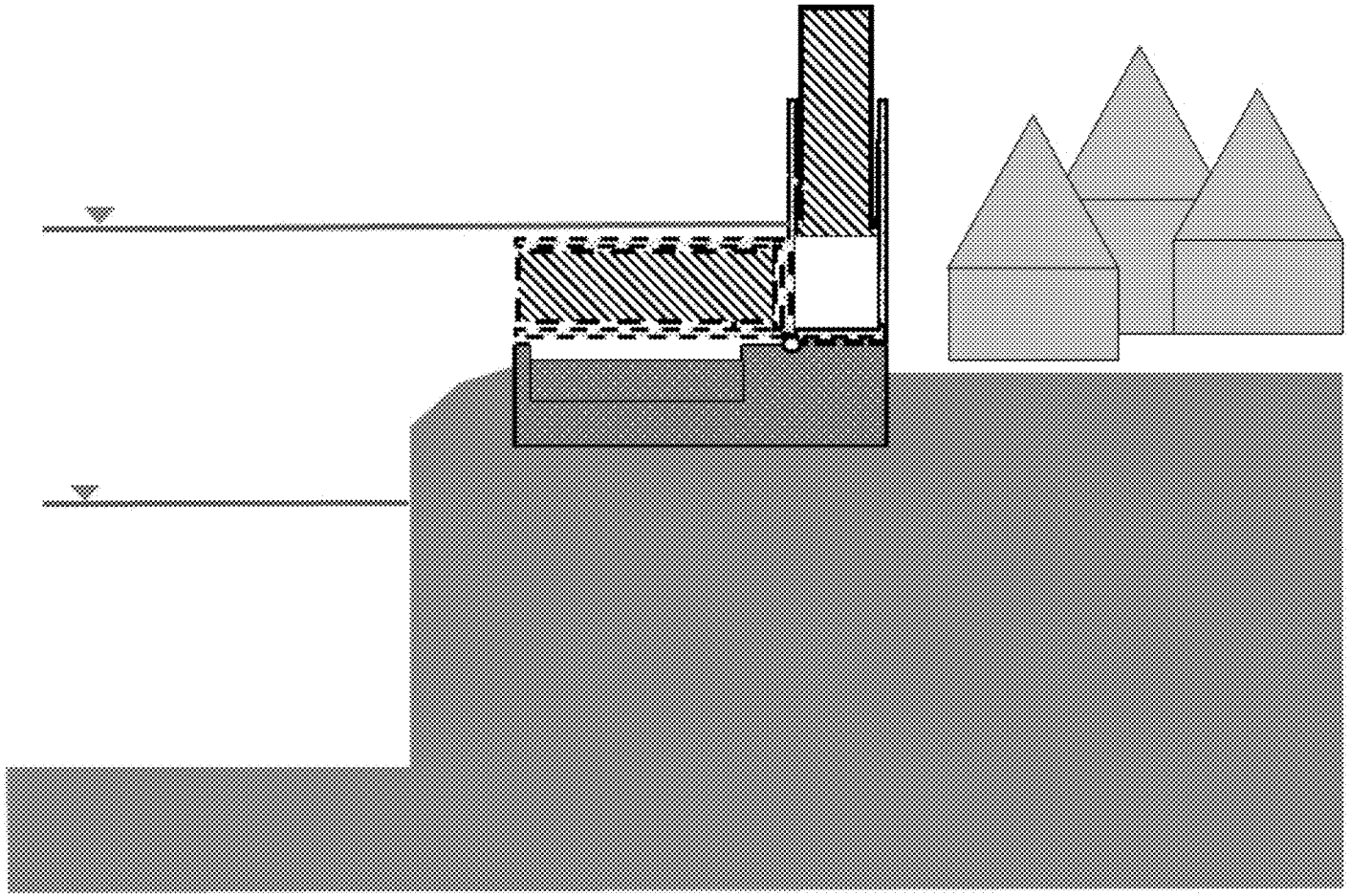
FIG. 10 illustrates the boardwalk/flood-barrier that is deployed adjacent to a bulkhead along a waterway to protect communities from overflow during high water level and flooding events. The barrier may be constructed with the telescopic feature shown to achieve higher height when deployed.

In another embodiment, a boardwalk that can be deployed as a flood-barrier is shown in FIG. 10 that can be positioned adjacent to bulkheads along a waterway to protect communities from overflow during high water level and flooding events. The barrier may be constructed with the telescopic feature shown to achieve higher deployed height. The telescopic feature also allows for adjustment of the flood barrier height along the waterway for uneven topography such that the height of the wall can be increased at land depressions. The boardwalk may be deployed using any one of the mechanisms described for the aforementioned embodiments. The displacing wall of the telescopic boardwalk may be deployed together with the boardwalk via a simple rotary to translation mechanism. Alternatively, the displacing wall sections may be made with materials, such as with enclosed void spaces, to make them floatable in water so that they are automatically deployed with rising water levels.

The boardwalk structure can also be designed to cantilever over a waterway/canal if space is limited.

Other embodiments/variations include a portable boardwalk configured so as to be taken away (stored away) when not in season; a mechanism of support that any backward rotation of the boardwalk panel would increasingly dig the bracing and other support elements into the ground; where the boardwalk is modular so that it can be used for any beaches with varying topography and geometry and would be easier to replace or fix defected pieces; a telescopic mechanism to adjust seawall elevation; where the panels (or sets of panels) may be used to form wave reflecting surfaces that together reflect the waves such that they interact (phased) to dissipate wave energy—thereby minimizing the energy of the wave as it hits the shore (walls); and proper orientation of wall sections in a harbor to dissipate the energy of the incoming (particularly longer wavelength) waves—dissipate the generated higher frequency waves.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A walkway for use along a shoreline of a body of water, the walkway comprising:

a foundation base at least partially embedded in ground adjacent to the body of water;

first and second supports, at least the first support being connected to the foundation base;

a plank having a surface for use by pedestrians to travel along the shoreline, the plank having a first end rotatably connected to the first support and having a second end supported on the second support, the surface being exposed for use by the pedestrians when the plank is in a first position where the second end is supported by the second support, the plank having a length between the first and second supports; and a lifting mechanism operatively connected to the plank to rotate the plank from the first position to a second position where the length of the plank is oriented in a first direction to impede a rising height of the body of water;

wherein the plank is rotatably supported on the first support such that a force of the rising height of the body of water on the plank acts to bias the plank toward the second position; and the plank includes a pressure relief member configured such that water pressure above a threshold value acting on the pressure relief member causes the pressure relief member into a position to allow a portion of the rising water to pass through the plank when the plank is in the second position.

2. The walkway of claim 1, wherein each of the first and second supports are connected to the foundation base.

3. The walkway of claim 1, wherein the plank comprises a plurality of planks arranged in series in a second direction along the shoreline of the body of water.

4. The walkway of claim 3, further comprising a seal provided between adjacent pairs of the plurality of planks.

5. The walkway of claim 1, wherein at least one of the first and second supports comprises a plurality of supports arranged in a second direction along the shoreline of the body of water.

6. The walkway of claim 1, wherein the lifting mechanism comprises a hinge for rotatably connecting the first end of the plank to the first support; and a gear arrangement for providing a mechanical advantage in rotating the plank from the first position to the second position.

7. The walkway of claim 1, wherein the first end of the plank comprises a seal to inhibit water intrusion between the first end of the plank and the first support.

8. The walkway of claim 1, further comprising:

a third support, wherein the first support is disposed between the second and third supports; and a support member connected at one end to the third support and on another end to the plank at a position between the first and second ends.

9. The walkway of claim 8, wherein the support member has a variable length between the one end and the other end.

10. The walkway of claim 8, wherein the one end of the support member is rotatably disposed to the third member and the other end is rotatably disposed to the plank.

11. The walkway of claim 1, wherein the plank includes a curved surface exposed to the water when the plank is in the second position, the curved surface acting to reflect the water back away from the plank when the plank is in the second position.

12. The walkway of claim 1, wherein the length of the plank in the first direction is variable.

13. A walkway for use along a shoreline of a body of water, the walkway comprising:

a foundation base at least partially embedded in ground adjacent to the body of water;

first and second supports, at least the first support being connected to the foundation base;

a plank having a surface for use by pedestrians to travel along the shoreline, the plank having a first end rotatably connected to the first support and having a second end supported on the second support, the surface being exposed for use by the pedestrians when the plank is in a first position where the second end is supported by the second support, the plank having a length between the first and second supports; and a lifting mechanism operatively connected to the plank to rotate the plank from the first position to a second position where the length of the plank is oriented in a first direction to impede a rising height of the body of water;

wherein the plank is rotatably supported on the first support such that a force of the rising height of the body of water on the plank acts to bias the plank toward the second position;

the plank includes a plurality of steps exposed to the water when the plank is in the second position, the plurality of steps being configured to permit a user to climb the plank along the length; and each of the plurality of steps includes a movable step portion that is movable between a retracted position and an extending position in which a length of tread portion of the plurality of steps is increased.

* * * * *